US010174526B2

(12) United States Patent
Ramachandran et al.

(10) Patent No.: US 10,174,526 B2
(45) Date of Patent: Jan. 8, 2019

(54) DOUBLE SHACKLE LOCK

(71) Applicant: SCHLAGE LOCK COMPANY LLC, Carmel, IN (US)

(72) Inventors: Sharath Kumar Ramachandran, Bangalore (IN); Anvesh Gangadharan, Kannur (IN); Sushanth Kondi Ananda Rao, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 15/434,637

(22) Filed: Feb. 16, 2017

(65) Prior Publication Data

US 2018/0230714 A1 Aug. 16, 2018

(51) Int. Cl.
*E05B 71/00* (2006.01)

(52) U.S. Cl.
CPC ..... *E05B 71/00* (2013.01)

(58) Field of Classification Search
CPC ... E05B 71/00; E05B 15/0046; E05B 15/0053
USPC ..... 70/14, 18, 227, 233, 19, 38 C, 94, 202, 70/203, 211, 212, DIG. 9, DIG. 64, 70/DIG. 65, DIG. 66, 51, 53, 177, 178, 70/180, 209, 225, 226, 228, 238; 292/256, 258, 259 R, DIG. 44, 288–290, 292/292, 295–298, 338, 339
See application file for complete search history.

(56) References Cited

U.S. PATENT DOCUMENTS 1,864,883 A * 6/1932 Anderson ..... E05C 19/182 292/296
3,245,239 A 4/1966 Zaidener
3,392,471 A * 7/1968 Foote ..... F41A 17/02 42/70.06
3,423,968 A * 1/1969 Foote ..... E05C 19/182 70/14
3,664,164 A 5/1972 Zaidener
(Continued)

FOREIGN PATENT DOCUMENTS

DE 3506049 A1 8/1986
DE 102012012560 A1 1/2014
JP 3356976 B2 4/1999

OTHER PUBLICATIONS

International Search Report; International Searching Authority; International Patent Application No. PCT/US2018/000040; dated May 23, 2018; 2 pages.
(Continued)

*Primary Examiner* — Lloyd A Gall
(74) *Attorney, Agent, or Firm* — Taft Stettinius & Hollister LLP

(57) ABSTRACT

A bicycle lock including a lock body having a locked state and an unlocked state. A movable shackle is operatively coupled to the lock body, wherein the lock body in the locked state prevents movement of the movable shackle, and wherein the lock body in the unlocked state enables movement of the movable shackle. A pawl is mounted to one of the lock body and the movable shackle. A rack is configured to engage the pawl, and wherein the unlocked state of the lock body enables at least one of bidirectional movement of the pawl and rotational movement of the rack away from engagement with the pawl.

17 Claims, 11 Drawing Sheets

(56) References Cited

U.S. PATENT DOCUMENTS 3,855,825 A * 12/1974 Pickard ..... E05B 71/00 70/14
3,953,992 A 5/1976 Toppel
4,003,227 A * 1/1977 Casey ..... E05B 13/002 292/258
4,068,504 A * 1/1978 Pickard ..... E05B 71/00 70/14
4,617,810 A * 10/1986 Fish ..... E05B 65/0894 70/14
4,848,110 A 7/1989 Kuo
5,197,310 A 3/1993 Pedersen
5,247,815 A * 9/1993 Caldwell ..... B60R 25/093 188/32
5,267,458 A 12/1993 Heh
5,291,761 A * 3/1994 Lii ..... B62H 5/003 70/18
5,388,436 A * 2/1995 Shieh ..... B62H 5/18 188/69
5,515,947 A * 5/1996 Shieh ..... B62H 5/18 188/265
5,613,385 A * 3/1997 Yamabe ..... B60R 25/093 188/32
5,873,275 A 2/1999 Lukich
5,992,192 A 11/1999 Tual et al.
6,058,749 A 5/2000 Rekemeyer
6,462,431 B1 * 10/2002 Woo ..... B62H 5/14 307/125
6,666,051 B1 * 12/2003 Li ..... B60D 1/60 280/507
6,694,781 B1 * 2/2004 Li ..... B60D 1/06 280/507
6,694,784 B2 2/2004 Wu
6,698,256 B2 * 3/2004 Witchey ..... B60D 1/02 280/507
6,755,450 B1 * 6/2004 Chen ..... E05C 19/182 292/289
6,763,690 B2 * 7/2004 Galant ..... E05B 73/0082 248/553
6,817,215 B1 11/2004 Chen
6,880,375 B1 * 4/2005 Pettingill ..... B60R 25/093 70/18
7,377,135 B2 * 5/2008 Copus ..... E05B 13/002 292/258
8,707,745 B2 * 4/2014 Kalous ..... B62D 33/037 280/507
8,733,141 B2 5/2014 Cheatham
8,800,328 B2 * 8/2014 Dubbey ..... E05C 19/186 292/259 R
8,851,535 B2 10/2014 Miskel et al.
8,978,427 B2 * 3/2015 Ho ..... E05B 73/0017 70/14
2005/0252258 A1 11/2005 Peacock
2010/0242554 A1 9/2010 Hogesta
2015/0167359 A1 6/2015 Luna
2015/0184427 A1 7/2015 Blackman

OTHER PUBLICATIONS

Written Opinion; International Searching Authority; International Patent Application No. PCT/US2018/000040; dated May 23, 2018; 6 pages.

* cited by examiner

DOUBLE SHACKLE LOCK

FIELD OF THE INVENTION

The present disclosure relates to a security device, and more particularly to a lock for securing a bicycle.

BACKGROUND

Lightweight transportation vehicles can be stolen due to the ease with which the vehicles can be removed when stored or parked. In particular, bicycles are often subject to theft since a bicycle can simply be ridden away if not properly stored or protected. To reduce or eliminate the theft of vehicles such as bicycles, a wide variety of bicycle locks have been proposed, including various U-locks and cable locks.

A U-lock typically includes a semi-enclosure member or shackle having legs or fittings with configured feet, a straight crossbar having openings for receipt of the feet, and a locking mechanism in the crossbar for retaining or releasing the feet. A cable lock typically includes a relatively flexible cable having at one end a leg or fitting with a configured foot, and a lock housing extending from the other end of the cable. The lock housing includes an opening for reception of the foot, and a locking mechanism in the lock housing to releasably retain the foot. For protection against theft, either of the locks can be used to couple a bicycle frame to a suitable object, such as a post, rail, rack or station. Once the U-lock or cable lock couples the bicycle frame to the suitable object, the lock is secured or locked to prevent or reduce the likelihood of theft.

While both U-locks and cable locks are capable of securing a bicycle to an object, neither of these types of locks provide complete protection from a thief having unlimited time and/or tools. For instance, some types of locks provide little protection when confronted by a thief using certain kinds of tools to either break the lock housing, breach or cut the shackle, or cut the cable of a cable lock. What is therefore needed is a bicycle lock which provides an increased level of security for these and other items that are subject to theft.

SUMMARY

The present invention is directed to a bicycle lock for securing a bicycle or to reduce the likelihood of theft of a bicycle. The bicycle lock includes a first shackle and a second shackle configured to engage a bicycle.

In one embodiment, there is provided a lock including a lock body having a locked state and an unlocked state, and a movable shackle operatively coupled to the lock body. The lock body in the locked state prevents movement of the movable shackle, and the lock body in the unlocked state enables movement of the movable shackle. A pawl is mounted to one of the lock body and the movable shackle, and a rack is configured to engage the pawl. The unlocked state of the lock body enables at least one of bidirectional movement of the pawl and rotational movement of the rack away from engagement with the pawl.

In another embodiment, there is provided a bicycle lock for a bicycle having a seat stay including a first tube and a second tube extending from a seat to an axle of a wheel having spokes. The bicycle lock includes a lock body having a rotatable end wherein the lock body has a locked position and an unlocked position. A first shackle and a second shackle are operatively coupled to the lock body. The lock body in the locked position substantially prevents movement of the second shackle, and the lock body in the unlocked position enables movement of the second shackle. A ratchet assembly is mounted to the lock body and to the second shackle. The ratchet assembly includes a pawl and a rack, wherein the rotatable end of the lock body substantially enables free movement of the second shackle with rotation of one of the pawl and rack.

In still another embodiment, there is provided a method for locking and unlocking a bicycle lock including a lock body having a first position and a second position. The method includes moving a terminating end of the lock body from the first position to the second position, and adjusting a ratchet assembly having a pawl and a rack in response to the movement of the terminating end of the lock body, wherein movement of the pawl is restricted in the first position of the lock body, and wherein movement of the pawl is unrestricted in the second position.

DETAILED DESCRIPTION OF ILLUSTRATIVE EMBODIMENTS

Figure 1:
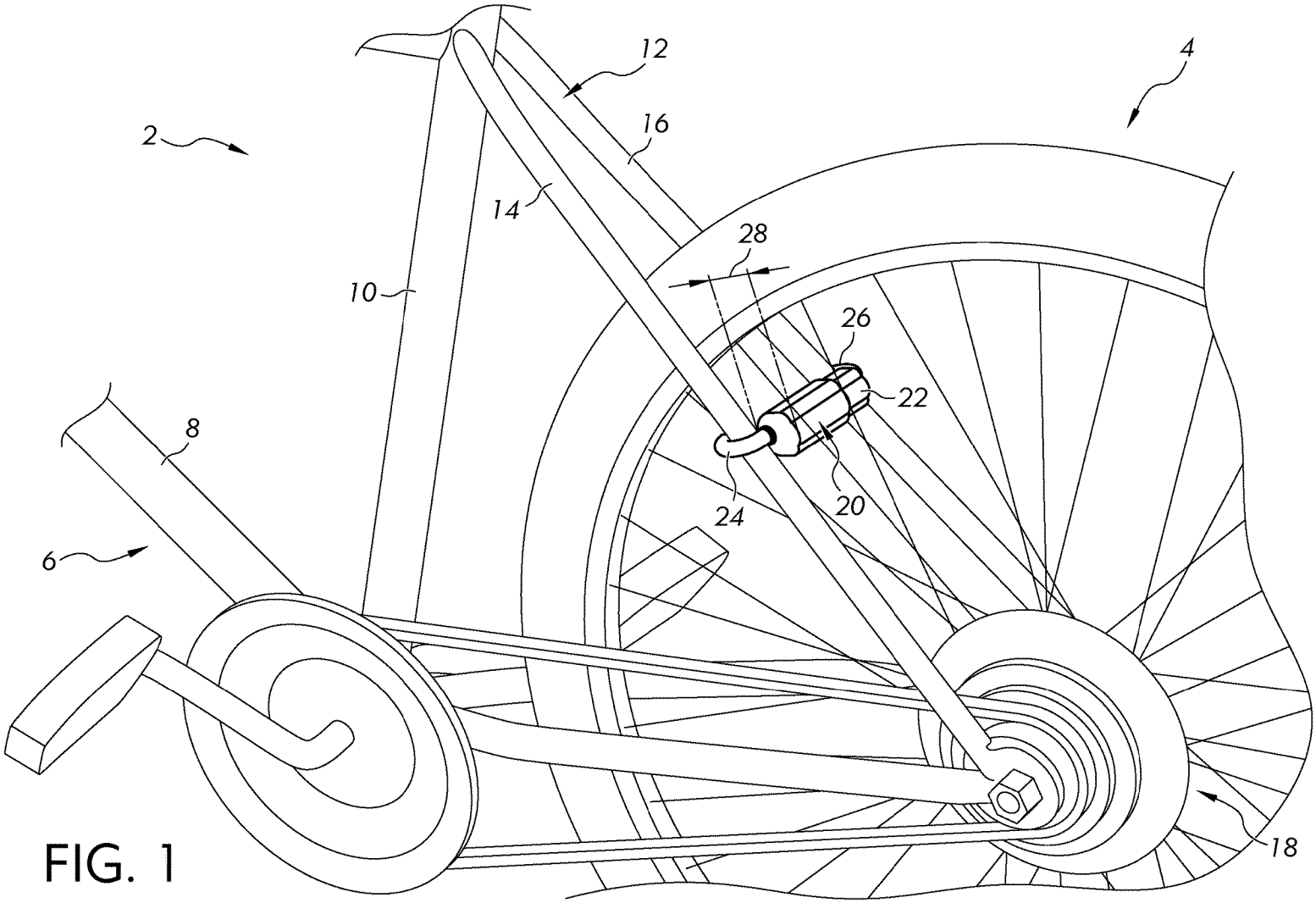
FIG. 1 is a perspective view of a bicycle secured with a shackle lock.

For the purposes of promoting an understanding of the principles of the invention, reference will now be made to the embodiments illustrated in the drawings where specific language is used to describe the same. It should be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a perspective view of a rear portion of a bicycle 2 having a rear wheel 4 supported by a frame 6. The bicycle frame 6 includes a down tube 8 and a seat tube 10 which is operatively coupled to a seat. A seat stay 12 includes a first tube 14 and a second tube 16, each of which extend to an axle 18 of the bicycle 2.

A double shackle bicycle lock 20 includes a housing 22, a first shackle 24, and a second shackle 26. Each of the first shackle 24 and the second shackle 26 extend from the housing 22 and are configured to respectively engage the first tube 14 and the second tube 16. The housing 22 includes a dimension, such as a width 28, which is less than a distance between adjacent spokes of the wheel 4. Placement of the housing 22 between the spokes positions the first shackle 24 and the second shackle 26 at a location to engage the first tube 14 and the second tube 16, respectively. The position of one or both of the first shackle 24 and the second shackle 26 are adjustable with respect to the housing 22 such that each of the shackles securely engages the seat tubes when the lock 20 is locked. When the lock 20 is locked in place, the wheel 4 is substantially prevented from rotating such that the bicycle cannot be ridden away unless the lock 20 is removed. In one embodiment, each of the first shackle 24 and the second shackle 26 are formed as a hook or arc-shaped element.

Figure 2:
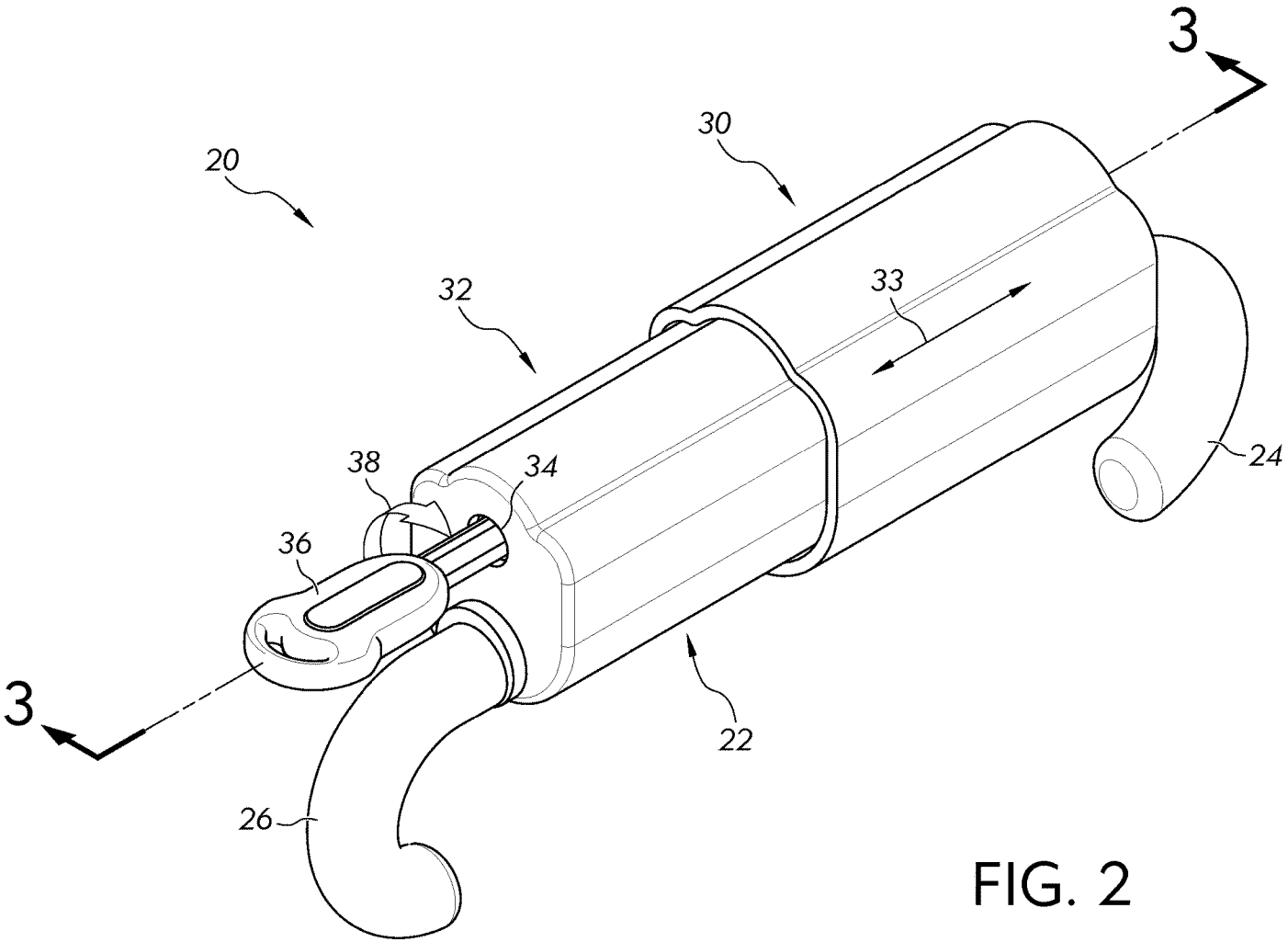
FIG. 2 is a perspective view of a shackle lock including a housing, a first shackle, and a second shackle.

FIG. 2 illustrates a perspective view of the lock 20 including the housing 22, the first shackle 24, and the second shackle 26. The housing 22 includes a first section 30 from which the first shackle 24 extends, and a second section 32 of the housing 22 slidingly engages the first section 30 such that the first and second sections 30, 32 are telescopically displaceable with respect to one another along a longitudinal axis 33 of the lock 20. The second shackle 26 is operatively connected to the second housing 32 such that the distance between the first shackle 24 and the second shackle 26 is variable or adjustable. The second housing 32 further includes a keyhole 34 configured to accept a key 36. Rotational movement 38 of the key 36 about a key axis transitions the lock 20 from a locked state to an unlocked state, and vice versa.

Figure 3:
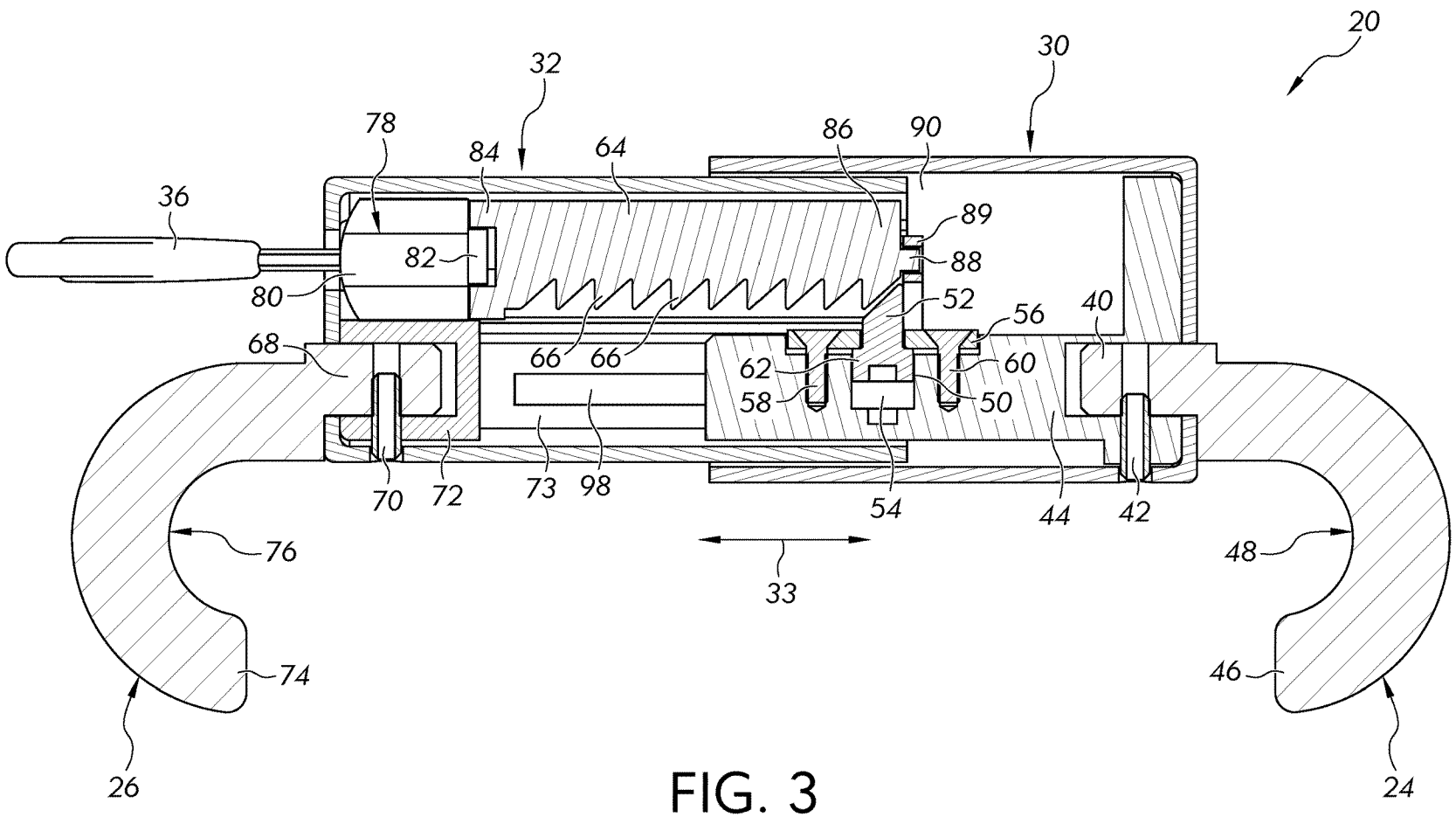
FIG. 3 is a cross sectional view of FIG. 2 taken along line 3-3 of FIG. 2.

FIG. 3 illustrates a cross sectional view of FIG. 2 taken along line 3-3 of FIG. 2. The first shackle 24 includes a terminating end 40 fixedly coupled to the first section 30 via a connector 42 which extends through the housing 30, through a base 44 located within the first section 30, and into the terminating end 40 of the first shackle 24. The shackle 24 includes a curved portion 46 which includes an arcuate contact surface 48 defined by the shackle 24 and sized and configured to engage one of the first and second tubes 14, 16. The base 44, which is fixed to the first section 30 and to the first shackle 24, includes an aperture 50 configured to accept a pawl 52 which moves in a direction substantially perpendicular to the longitudinal axis 33 of the lock 20. The pawl 52 is spring loaded to be biased away from the base 44 by a spring 54 located in the aperture 50 between the pawl 52 and the base 44. A plate 56 is fixedly coupled to the base 44 with a first connector 58 and a second connector 60. The pawl 52 includes a shoulder 62 which prevents the pawl 52 from escaping the aperture 50.

A rack 64 is fixedly located within the second section 32 of the housing 22 and includes a plurality of teeth 66 configured to engage the pawl 52. The rack 64 and the pawl 52 form a ratchet device which enables a distance between the shackles 24 and 26 to be fixed at variable or adjustable lengths depending on the engagement of the pawl 52 with a selected one of the teeth 66.

The shackle 26 includes a terminating end 68 which is fixedly coupled to the second section 32 with a connector 70 that extends through the housing 22, a collar 72, and the terminating end 68. In one embodiment, the collar 72 constitutes a part of a body 73 which is fixed within the second section 32 of the housing 22. In another embodiment, the collar 72 is a separate from the body 73. A curved portion 74 of the shackle 26 includes an arcuate contact surface 76 sized and configured to engage one of the first tube 14 and the second tube 16.

A lock cylinder 78 is located adjacent to the collar 72 and is fixed with respect to both the housing 22 and the collar 72. The lock cylinder 78 is configured to receive the key 36 which transitions the lock cylinder 78 from a locked position to an unlocked position, and vice versa. When the key 36 is in the locked position, each of the shackles 24 and 26 can be brought closer together to provide an automatic locking feature. When the shackles 24 and 26 are brought closer to each other, the pawl 52 slips past each of the teeth 66, until the shackles of the lock 20 engage the first tube 14 and the second tube 16 sufficiently to lock the bicycle. To unlock the lock 20, the key 36 is necessary.

The lock cylinder 78 includes a plug 80 having a terminating end 82, or cam, which is fixedly coupled to a first end 84 of the rack 64. A second end 86 of the rack 84 includes a pin 88 which extends into an aperture 89 of a rack support 90, or rack guide, which is in turn fixed with respect to the second section 32 of the housing 22. In one embodiment, the rack support 90 is integrally formed as a part of the housing 22 of the second section 32 to form a single-piece unitary structure. In another embodiment, the rack support 90 is a separate part fixedly connected to the housing of the second section 32.

Figure 4:
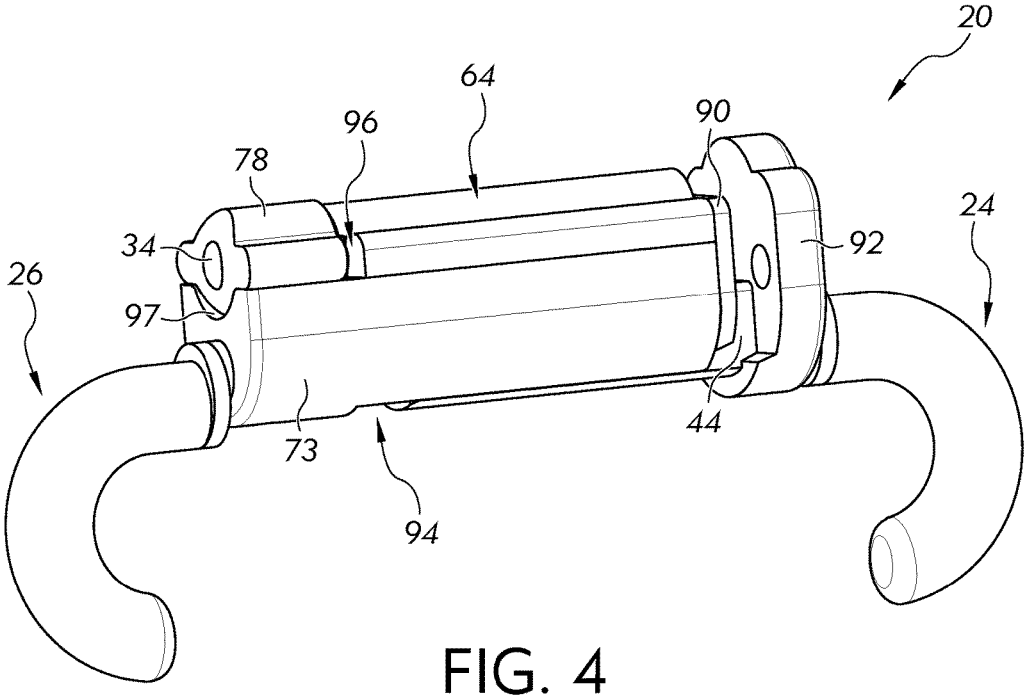
FIG. 4 is a perspective view of the shackle lock of FIG. 2 illustrated without the lock housing.
Figure 5:
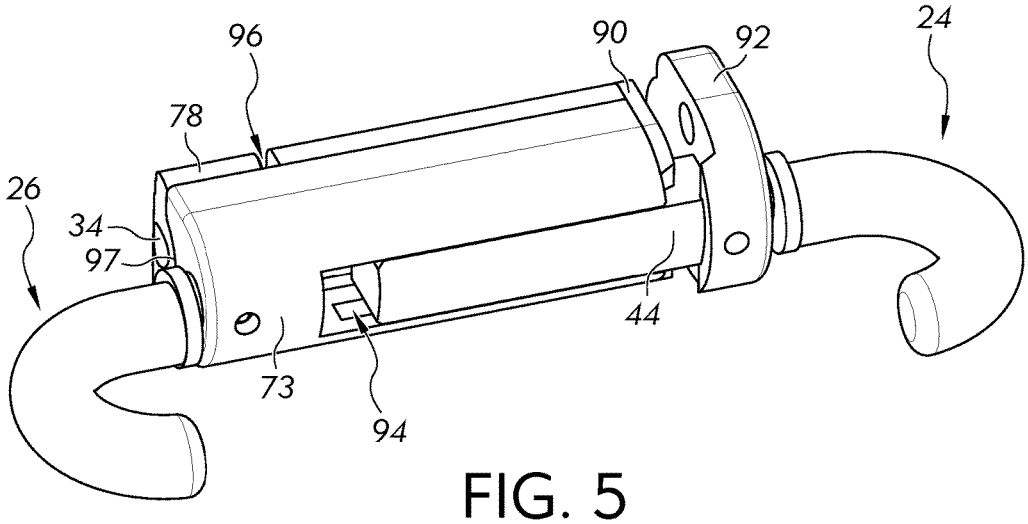
FIG. 5 is another perspective view of the shackle lock of FIG. 2 illustrated without the lock housing.

FIGS. 4 and 5 illustrate a partial view of the lock 20 of FIG. 2, with the first section 30 and the second section 32 of the housing 22 removed for clarity. The base 44 is fixedly coupled to an end plate 92 which is fixedly coupled to the shackle 24 and to the first section 30 of the housing 20. The body 73 defines a groove 94 which accommodates the base 44. The body 73 further includes a cavity 96 which accommodates the rack 64 and the lock cylinder 78. A recess 97 fixedly supports the lock cylinder 78. In one embodiment, the base 44 includes a longitudinal projection (not shown) which engages a channel 98, as shown in FIG. 3, to provide for relative sliding displacement of the base 44 and the body 73. The rack support 90 is fixedly coupled to the body 73.

Figure 6:
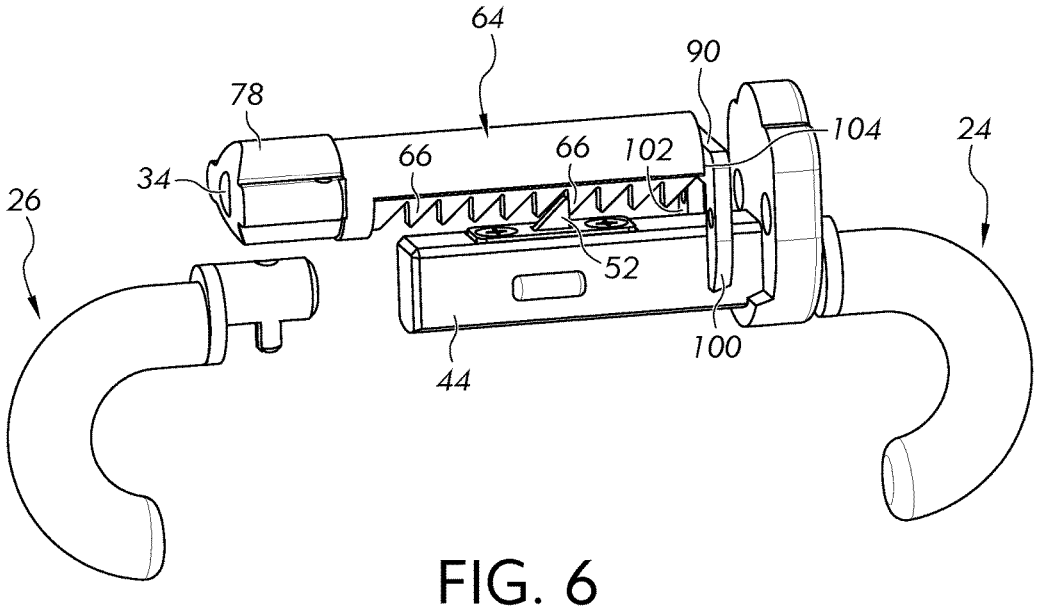
FIG. 6 is a partial perspective view of the shackle lock of FIGS. 4 and 5 illustrated without the lock body.

FIG. 6 illustrates a partial view of the lock 20 of FIG. 3 in which the body 73 is not shown for clarity. The support 90, which is coupled to the body 73, includes a first leg 100 and a second leg 102 extending from a base 104. The first and second legs 102, 104 are located on either side of the base 44 and move in either direction along the base 44 generally along a longitudinal axis.

As previously described, the support 90 includes an aperture 89 which supports the pin 88, and therefore the rack 64, for rotational movement resulting from turning of the key 36 which in turn rotates the plug 80. When the lock cylinder 78 is in the locked position (as illustrated in FIG. 6), the teeth 66 are aligned with the spring loaded pawl 52 such that relative movement of the shackles 24 and 26 occurs in only one direction (i.e., the shackle 24 moves to the left, as illustrated, and toward the shackle 26 which is fixed). Each time the pawl 52 is moved to a different space between adjacent teeth 66 as the shackles 24 and 26 are moved closer together, movement of the shackles in opposite directions is substantially prevented. In this locked state, the lock 20 is inserted between adjacent spokes of the wheel and the shackles are pushed together until each of the shackles engages the appropriate first tube 14 and second tube 16.

Figure 7:
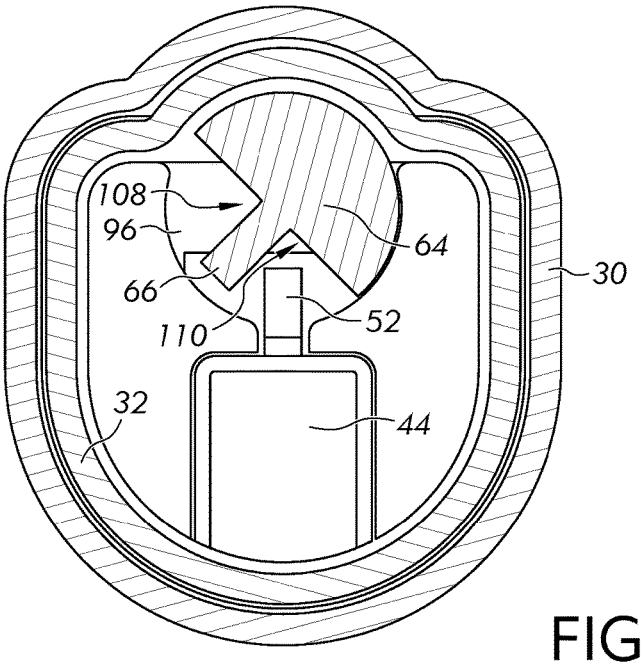
FIG. 7 is cross sectional view of a ratchet assembly associated with the lock body of the shackle lock.

To unlock the lock 20, the key 36 is rotated in the appropriate direction, which in rotates the rack 64 about a longitudinal axis to an unlocked position, as shown in FIG. 7. The rack includes a first passage 108 and a second passage 110, each of which extends along the longitudinally aligned teeth 66. When the rack 64 is moved to an unlocked position, the teeth 66 are no longer aligned with the pawl 52 and, consequently, respective longitudinal movement of the first shackle 24 and the second shackle 26 is made possible. Once the teeth 66 are disengaged from the pawl 52, the distance between each of the first and second shackles 24 and 26 can be increased to a sufficient length to disengage the shackles from the tubes 14, 16 to unlock the lock 20 and the bicycle 2.

Figure 8:
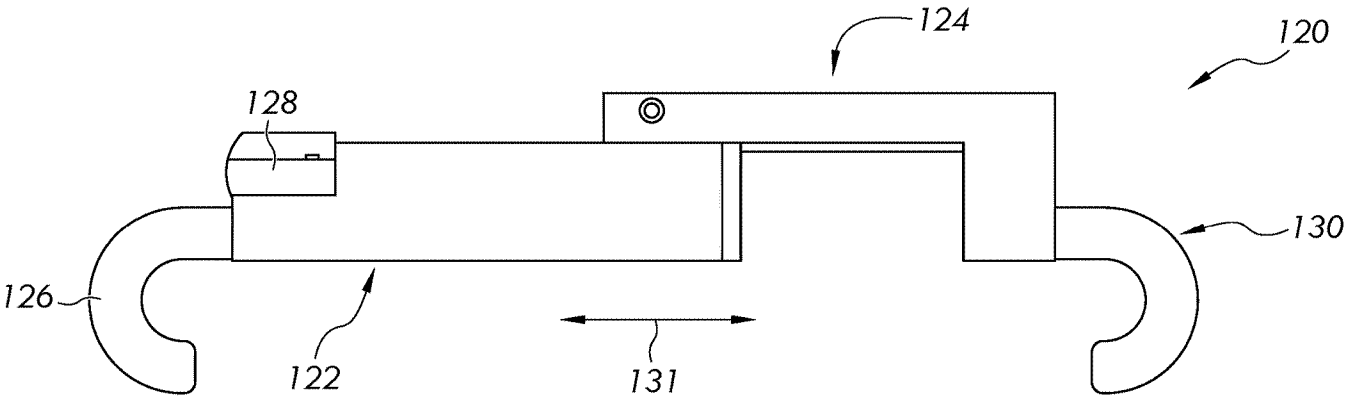
FIG. 8 is a side view of another embodiment of a shackle lock including a first shackle body and a second shackle body.
Figure 9:
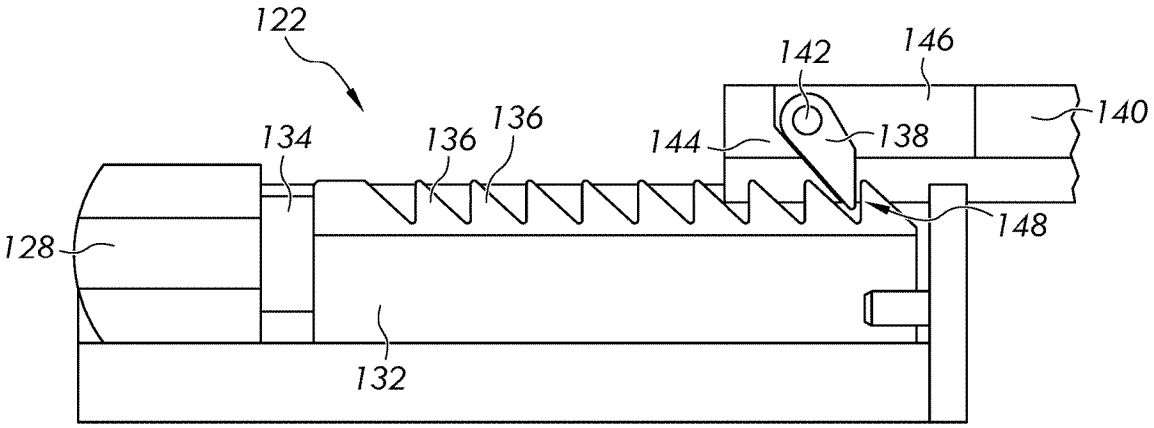
FIG. 9 is a partial view of the first and second shackle bodies of the shackle lock of FIG. 8.

FIG. 8 illustrates another embodiment of a bicycle lock 120 including a first shackle body 122 and a second shackle body 124. The first shackle body 122 includes a first shackle 126 fixedly coupled to the body 122, which also fixedly supports a lock cylinder 128. The second shackle body 124 includes a second shackle 130 fixedly coupled to the body 124, which slidingly engages the first shackle body 122 for movement along a longitudinal axis 131. Each of the first and second bodies 122 and 124 include housings which enclose internal components, as further illustrated in FIG. 9.

The first shackle body 122 includes a rack 132 which is rotatably coupled to the lock cylinder 128 via a cam 134. The rack 132 includes a plurality of upwardly facing teeth 136 which are aligned along a longitudinal axis of the first body 122 and configured to engage a pawl 138 rotatably coupled to a support 140 through a pin 142, both of which are located within the housing of the second body 124. The pawl 138 is located next to a shoulder 144 which is located next to a recess 146 in which the pawl 138 is located. Due to the location of the shoulder 144, rotation of the pawl 138 is limited in the clockwise direction, as illustrated.

When the lock 120 is located between the spokes of the bicycle wheel 4 for locking the bicycle 2, the first body 122 and the second body 124 are moved toward each other. During this movement, the pawl 138 successively engages adjacent teeth 136 until the shackles 126 and 130 move no further due to engagement with the tubes 14 and 16. Once in position, the first body 122 and the second body 124 are locked in place and cannot be separated unless the lock cylinder 128 is unlocked. This result occurs because rotational movement of the pawl 138 in the clockwise direction is prevented by the shoulder 144 and engagement of the pawl 138 with an upwardly extending portion 148 of a key 136.

Figure 10:
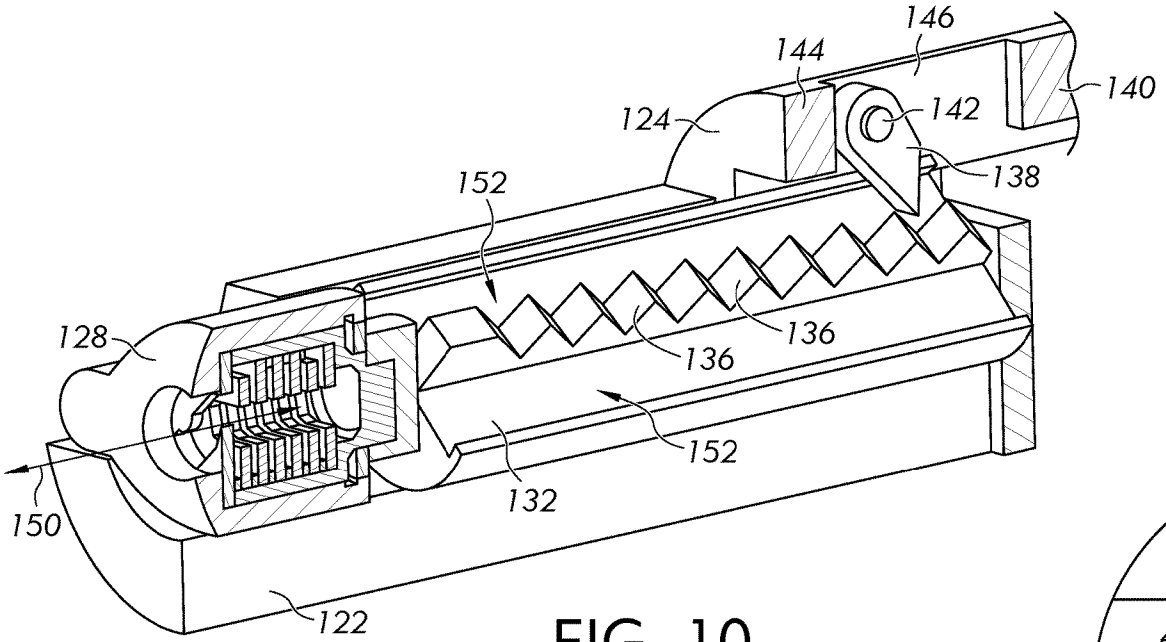
FIG. 10 is a partial perspective view of a lock cylinder and a ratchet assembly of the shackle lock of FIGS. 8 and 9.
Figure 11:
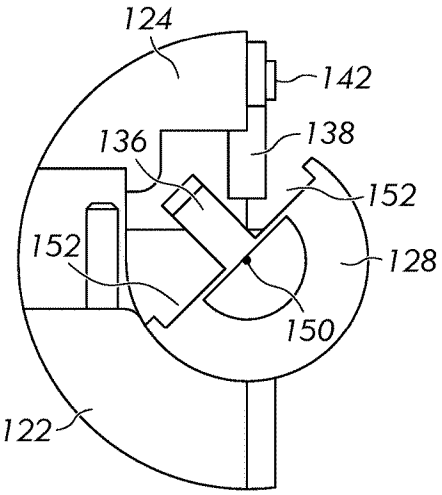
FIG. 11 is a partial sectional view of the lock body and the ratchet assembly of FIG. 10.

To unlock the bicycle lock 120, a key is inserted into the lock cylinder 128 to rotate the lock cylinder 128 about a rotational axis 150, as illustrated in FIGS. 10 and 11. Rotation of the rack 132 moves one of two passages 152 into alignment with the pawl 138. The teeth 136 are moved away from or disengaged from the pawl 138, and the first body 122 and the second body 124 are in turn free to move with respect to one another in both directions. Once unlocked, the shackles 126 and 130 are disengaged from the tubes 14 and 16 to unlock the bicycle 2.

Figure 12:
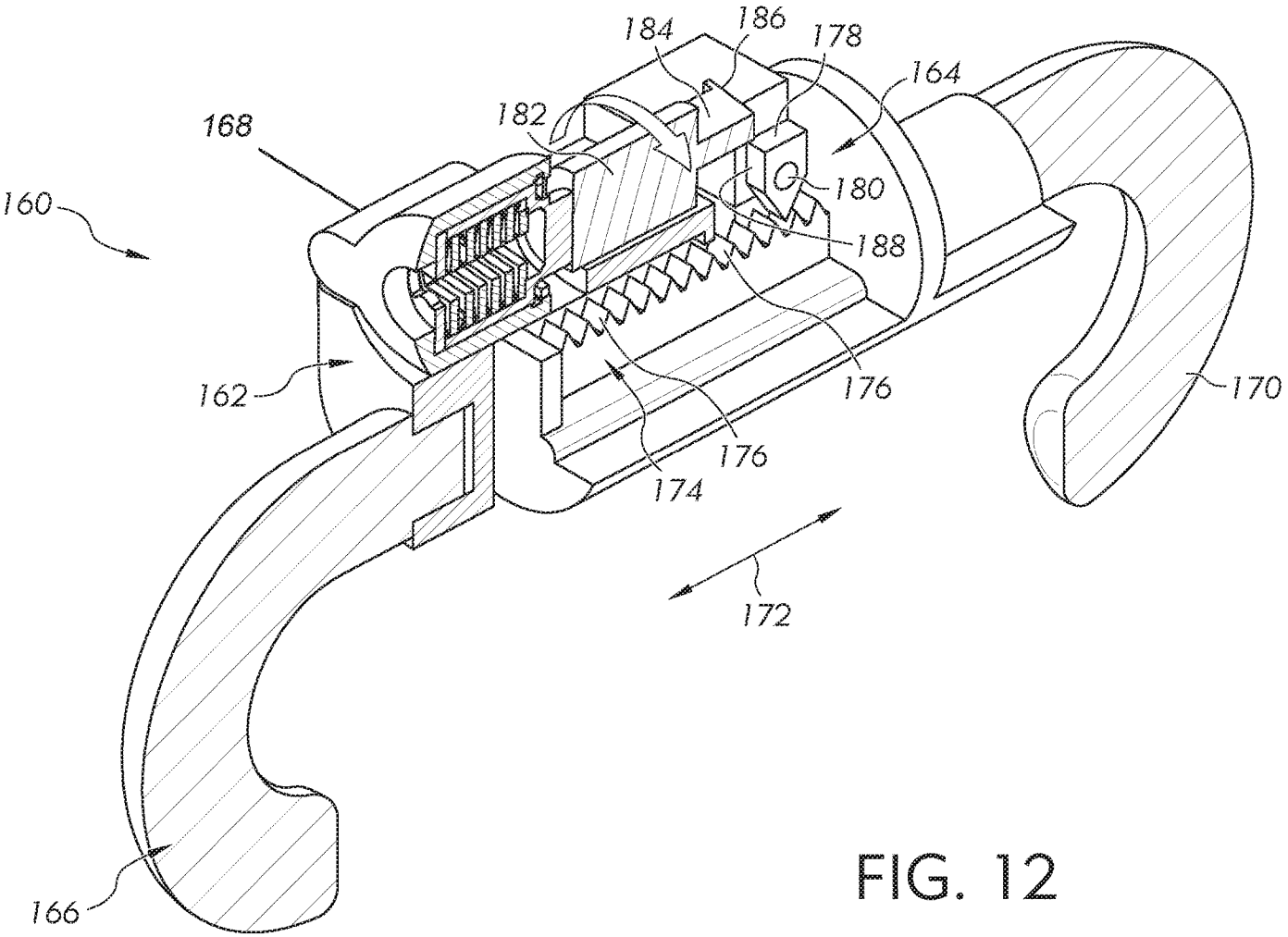
FIG. 12 is partial sectional perspective view of another embodiment of a shackle lock including a first shackle body and a second shackle body.
Figure 13:
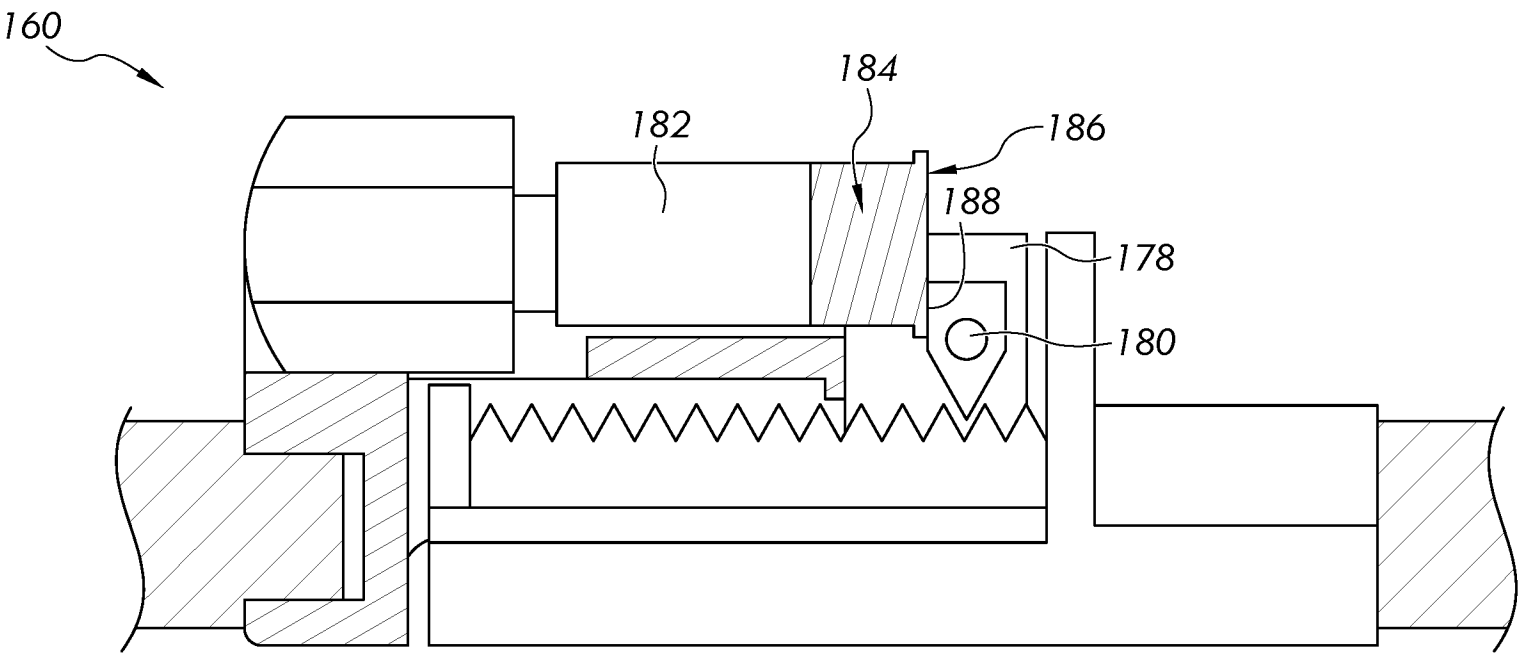
FIG. 13 is a partial sectional view of a portion of the shackle lock of FIG. 12.

FIGS. 12 and 13 illustrate another embodiment of a bicycle lock 160 including a first shackle body 162 and a second shackle body 164. The first shackle body 162 includes a first shackle 166 fixedly coupled to the shackle body 162, and which also fixedly supports a lock cylinder 168. The second shackle body 164 includes a second shackle 170 fixedly coupled to the shackle body 164, and which slidingly engages the first shackle body 162 for movement along a longitudinal axis 172. In different embodiments, one or both of the first and second bodies 162 and 164 include housings which enclose internal components.

The second shackle body 164 includes a rack 174 which is fixedly coupled to second shackle body 164. In one embodiment, the rack 174 constitutes a separate part connected to the second shackle body 164. In another embodiment, the rack 174 is formed with the second shackle body 164 to provide a single-piece, unitary part, such as by machining from a single piece of material. The rack 174 includes a plurality of upwardly facing teeth 176 which are aligned along a longitudinal axis of the second body 164 and configured to engage a pawl 178 rotatably coupled to the first shackle body 162 via a pin 180. The pawl 178 is configured to rotate in both clockwise and counterclockwise directions, as illustrated in FIG. 12.

In this embodiment, when movement of the pawl 178 is unrestricted, movement of the first lock body 162 and the second lock body 164 with respect to one another is possible in both directions along the longitudinal axis 172. To lock the bicycle lock 160, the lock cylinder 168 is moved to a locked position which in turn rotates a blocking cam 182 that is operatively connected to the lock cylinder 168.

Once the first and second shackles 166 and 170 have been located adjacent the first and second tubes 14 and 16, the bicycle lock 160 is locked by rotating the key, which in turn rotates the blocking cam 182 to the position shown in FIG. 13. The blocking cam 182 includes a projection 184 which includes a planar contact surface 186 that engages a side 188 of the pawl 178. In this position, the projection 184 prevents the pawl 178 from rotating about the pin 180, which in turn prevents relative movement of the first shackle body 162 with respect to the second shackle body 164.

To unlock the bicycle lock 160, a key is inserted into the lock cylinder 168 to rotate the blocking cam 182 to a position where the projection 184 in not engaged or positioned to block movement of the pawl 178. Once unlocked, the shackles 166 and 170 are disengaged from the tubes 14 and 16 to unlock the bicycle 2.

Figure 14:
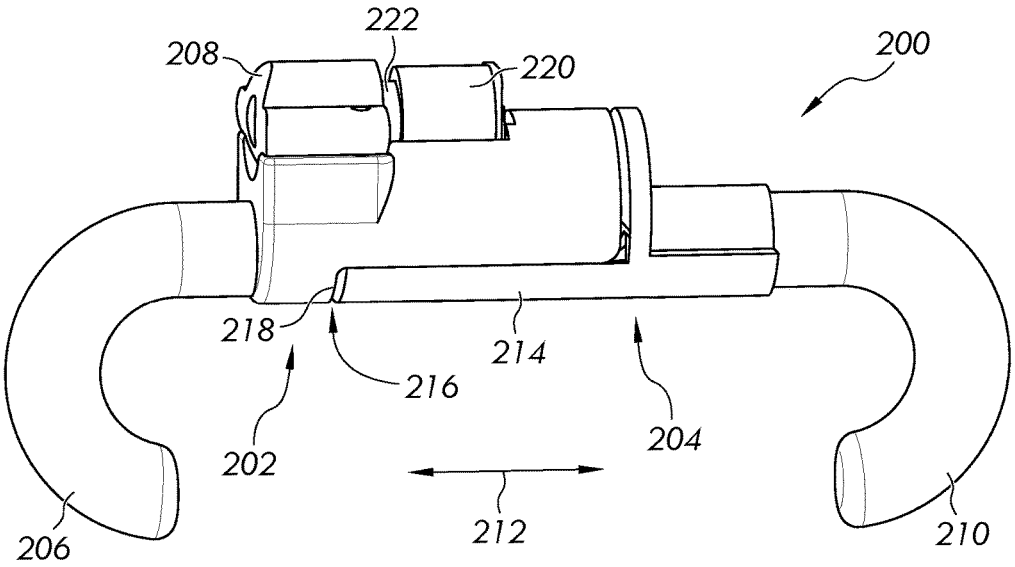
FIG. 14 is a side view of another embodiment of a shackle lock including a first shackle body and a second shackle body.
Figure 15:
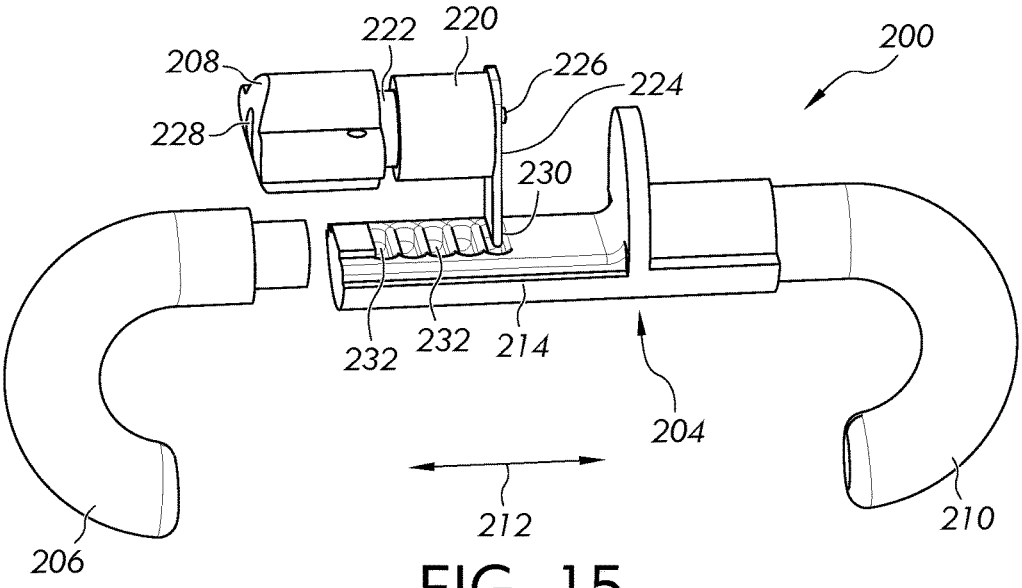
FIG. 15 is a partial view of the shackle lock of FIG. 14.

FIGS. 14 and 15 illustrate another embodiment of a bicycle lock 200 including a first shackle body 202 and a second shackle body 204. The first shackle body 202 includes a first shackle 206 fixedly coupled to the first shackle body 202, which also fixedly supports a lock cylinder 208. The second shackle body 204 includes a second shackle 210 fixedly coupled to the body 204, which slidingly engages the first shackle body 202 for movement along a longitudinal axis 212. In other embodiments, one or both of the first and second bodies 202 and 204 include housings which enclose internal components of the lock.

The second shackle body 204 includes a projecting portion 214 which slidingly engages the first body 202 at a receiving area 216, and which receives the projecting portion 214. The receiving area 216 terminates at an end 218 which, in one embodiment, limits movement of the second body 204 toward the first body 202. The first body 202 is fixedly coupled to the shackle 206 and provides support for the lock cylinder 208 as well as a cam 220 that is rotatably coupled to the lock cylinder 208 via a link 222.

As further shown in FIG. 15, the first shackle body 202 is removed to illustrate a locking shim 224 which is fixedly located at an end of the cam 220 via a connector 226. The cam 220 rotates in response to rotation of a key inserted into an aperture 228 of the lock cylinder 208. The locking shim 224 extends from the cam 220 and is transverse with respect to the longitudinal direction 212. An end 230 extends, in one embodiment, at a generally ninety (90) degree angle with respect to the longitudinal direction 212 to engage one of a plurality of recesses 232 which are located in the projection portion 214. When the end 230 of the locking shim 224 engages one of the recesses 232, the location of the first shackle 206 with respect to the second shackle 210 remains relatively fixed to lock the bicycle 2 when the lock 200 is utilized, as described herein. To unlock the lock 200, a key inserted in the aperture 228 is rotated to rotate the end 230 of the shim 224 away from the recesses.

Figure 16:
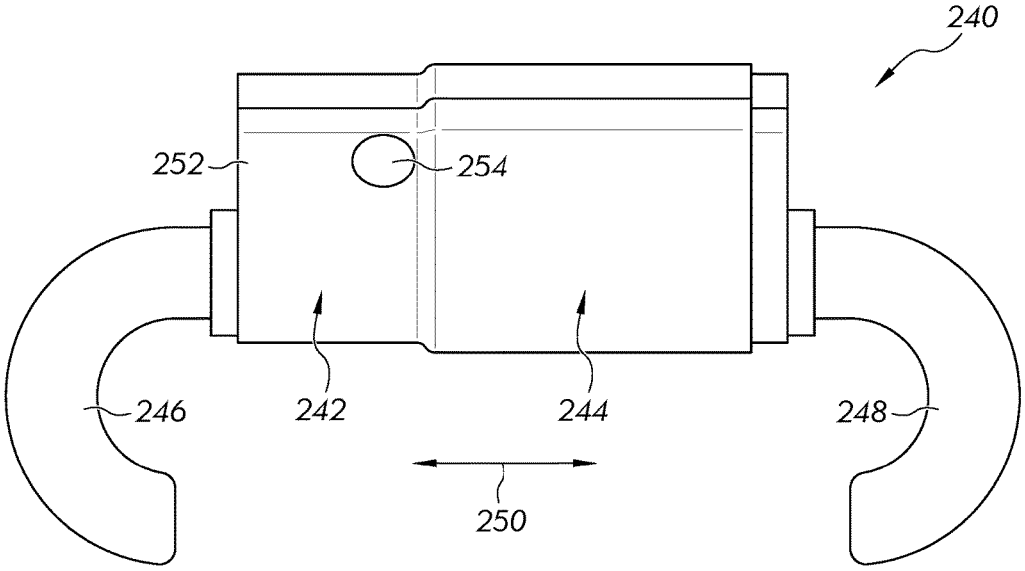
FIG. 16 is a side view of another embodiment of a shackle lock including a first shackle body and a second shackle body.

FIG. 16 illustrates another embodiment of a bicycle lock 240 including a first shackle body 242 and a second shackle body 244. The first shackle body 242 includes a first shackle 246 fixedly coupled to the first shackle body 242, which also fixedly supports a lock cylinder, as previously described. The second shackle body 244 includes a second shackle 248 fixedly coupled to the body 244, which in turn slidingly engages the first shackle body 242 for movement along a longitudinal axis 250.

Figure 17:
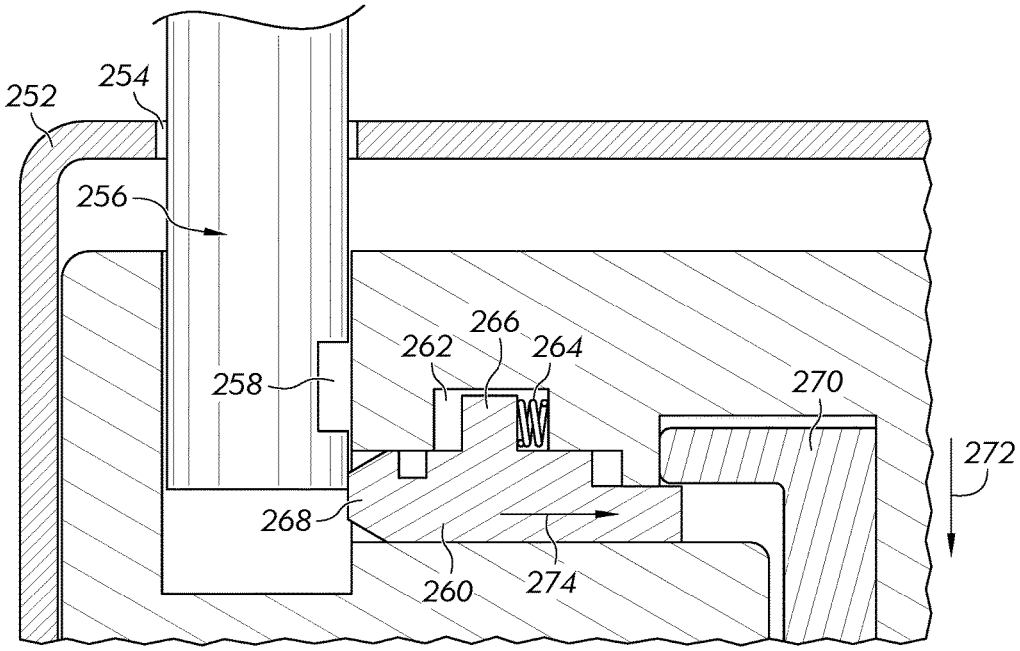
FIG. 17 is a partial cross sectional view of a housing of the first shackle body of the shackle lock of FIG. 16 defining an aperture configured to receive a terminating end of a locking cable.

In this embodiment, a housing 252 of the first shackle body 242 defines an aperture 254 configured to receive a terminating end 256 of a locking cable, as shown in FIG. 17. Locking cables, which are relatively flexible, are used to lock a bicycle to a fixed post or other fixed structure to prevent or to deter the bicycle from being removed from a secure location. The end 256 includes a slot or recess 258 configured to receive a catch 260. The catch 260 is located in a chamber 262 defined in the first body 242 and which is configured to enable sliding movement of the catch 260 therein. In one embodiment, the catch 260 is a relative thin piece of sheet metal having a sufficient thickness to provide a predetermined amount of rigidity to enable insertion and removal of the cable from the lock 240.

A spring 264 is located between a sidewall of the chamber 262 and a tab 266. The spring 264 tends to force the tab toward the aperture 254 such that an end 268 of the catch 260 is moved to engage the recess 258 to lock the cable to the lock 240. Once the recess 258 is located adjacent to the end 268, the spring 264 forces the end 268 into the recess 258. The cable is then locked to the lock 240 via movement of the lock cylinder, which in turn moves a plunger 270 in a direction 272 to position the plunger 270 next to the catch 260. Movement of the catch 260 in a direction 274 is prevented to keep the terminating end 256, and therefore the cable, locked to the lock 240. When the lock is unlocked, the plunger 270 returns to the illustrated position, and the end 268 retracts from the recess 258 to release the cable from the lock 240.

While the invention has been illustrated and described in detail in the drawings and foregoing description, the same is to be considered as illustrative and not restrictive in character, it being understood that preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock, comprising:

a lock body having a locked state and an unlocked state;

a first shackle operatively coupled to the lock body and a second shackle coupled to a base, wherein the first shackle includes a first hook, wherein the second shackle includes a second hook, wherein at least one of the first and second shackles is movable longitudinally along the lock body toward the other of the first and second shackles to secure an object between the first and second shackles with the lock body in the locked state, and the at least one of the first and second shackles is movable longitudinally away from the other of the first and second shackles to release the object from between the first and second shackles with the lock body in the unlocked state;

a pawl mounted to one of the lock body and the base; and a rack mounted to the other of the lock body and the base that is configured to engage the pawl, wherein the pawl and rack are configured to prevent the first and second shackles from moving longitudinally away from one another with the lock body in the locked state;

wherein the unlocked state of the lock body is provided by at least one of rotational movement of the pawl away from engagement with the rack and rotational movement of the rack away from engagement with the pawl, wherein the rack includes a plurality of teeth aligned longitudinally along the rack and at least one longitudinally extending passage along the teeth, wherein the pawl is positioned in the at least one longitudinally extending passage in the unlocked state of the lock body.

2. The lock of claim 1, wherein the lock body includes a lock cylinder that includes a terminating end coupled to an end of one of the rack and the pawl.

3. The lock of claim 2, wherein the lock body is fixedly coupled to the one of the rack and the pawl.

4. The lock of claim 3, wherein the rack includes a first position in which the rack engages the pawl, and a second position in which the rack does not engage the pawl.

5. The lock of claim 1 wherein the rotational movement includes bidirectional rotational movement to align the pawl with a respective one of first and second longitudinally extending passages that extend along opposite sides of the teeth of the rack.

6. The lock of claim 1, wherein the pawl is biased to engage at least one of the teeth of the rack.

7. The lock of claim 6, wherein the pawl moves substantially perpendicular to the rack to engage the at least one of the teeth in the locked state of the lock body.

8. A bicycle lock for a bicycle having a seat stay including a first tube and a second tube extending from a seat to an axle of a wheel having spokes, the bicycle lock comprising:

a lock cylinder configured to accept a key for rotating a terminating end of the lock cylinder between a locked position and an unlocked position;

a first shackle operatively coupled to a second shackle, wherein the first shackle includes a first hook configured to engage the first tube, wherein the second shackle comprises a second hook configured to engage the second tube, wherein the first and second shackles move longitudinally toward one another to engage the first tube and the second tube therebetween and move longitudinally away from one another to disengage the first tube and the second tube, and wherein the lock cylinder the unlocked position enables movement of the first shackle and the second shackle longitudinally away from one another; and a ratchet assembly mounted to the lock cylinder and the first shackle and to the second shackle, the ratchet assembly including a pawl and a rack that prevent the first shackle and the second shackle from substantial movement longitudinally away from one another, wherein the rack includes a plurality of longitudinally aligned teeth and at least one longitudinally extending passage along the teeth, wherein rotation of the lock cylinder from the locked position to the unlocked position rotates the pawl and rack to position the pawl in the at least one longitudinally extending passage of the rack.

9. The bicycle lock of claim 8, wherein the one of the pawl and the rack is rotatable about a longitudinal axis extending between the first shackle and the second shackle.

10. The bicycle lock of claim 8, wherein the one of the pawl and the rack is bi-directionally rotatable about a rotational axis.

11. The bicycle lock of claim 8, wherein the terminating end of the lock cylinder is configured to engage one of the rack and the pawl.

12. The bicycle lock of claim 11, wherein the terminating end of the lock cylinder is fixedly coupled to the one of the rack and the pawl.

13. The bicycle lock of claim 8, wherein the rack includes a first position in which the rack engages the pawl and a second position in which the rack does not engage the pawl.

14. The bicycle lock of claim 13, wherein the pawl is disposed in the at least one longitudinally extending passage with the rack in the second position.

15. The bicycle lock of claim 13, wherein the pawl is biased to engage at least one of the teeth of the rack with the rack in the first position.

16. The bicycle lock of claim 8, wherein the first shackle is fixedly coupled to a lock body.

17. The bicycle lock of claim 16, wherein the lock body has a size and shape that is positionable between adjacent spokes of the wheel.

* * * * *